US008446342B2

(12) United States Patent
Champion et al.

(10) Patent No.: US 8,446,342 B2
(45) Date of Patent: May 21, 2013

(54) PROJECTION SYSTEM WITH MULTI-PHASED SCANNING TRAJECTORY

(75) Inventors: Mark Champion, Kenmore, WA (US); Margaret K. Brown, Seattle, WA (US); Mark O. Freeman, Snohomish, WA (US)

(73) Assignee: Microvision, Inc., Redmond, WA (US)

( * ) Notice: Subject to any disclaimer, the term of this patent is extended or adjusted under 35 U.S.C. 154(b) by 1123 days.

(21) Appl. No.: 12/032,988

(22) Filed: Feb. 18, 2008

(65) Prior Publication Data

US 2008/0144150 A1 Jun. 19, 2008

Related U.S. Application Data

(63) Continuation-in-part of application No. 10/441,916, filed on May 19, 2003, now Pat. No. 7,580,007.

(60) Provisional application No. 60/381,569, filed on May 17, 2002.

(51) Int. Cl.
*G09G 1/08* (2006.01)

(52) U.S. Cl.
USPC ..... 345/15; 345/213; 345/204; 359/236; 359/237

(58) Field of Classification Search
USPC ..... 345/15, 213, 204; 359/199, 236, 359/237
See application file for complete search history.

(56) References Cited

U.S. PATENT DOCUMENTS

| | | | | |
|---|---|---|---|---|
| 2,543,066 | A | | 2/1951 | Salinger |
| 3,471,641 | A | | 10/1969 | Baker et al. |
| 3,686,435 | A | | 8/1972 | Ebeling |
| 4,298,965 | A | | 11/1981 | Kogo et al. |
| 4,736,107 | A | | 4/1988 | Myron |
| 4,819,196 | A | | 4/1989 | Lilley et al. |
| 4,975,691 | A | | 12/1990 | Lee |
| 5,097,257 | A | | 3/1992 | Clough et al. |
| 5,216,236 | A | | 6/1993 | Blais |
| 5,344,324 | A | | 9/1994 | O'Donnell et al. |
| 5,493,339 | A | | 2/1996 | Birch et al. |
| 5,659,327 | A | * | 8/1997 | Furness et al. ..... 345/8 |
| 5,936,764 | A | | 8/1999 | Kobayashi |
| 5,955,724 | A | | 9/1999 | Livingston |
| 6,038,051 | A | | 3/2000 | Suzuki et al. |
| 6,140,979 | A | | 10/2000 | Gerhard et al. |
| 6,183,092 | B1 | | 2/2001 | Troyer |
| 6,204,829 | B1 | | 3/2001 | Tidwell |
| 6,628,330 | B1 | | 9/2003 | Lin |
| 6,756,993 | B2 | | 6/2004 | Popescu et al. |
| 6,765,578 | B2 | | 7/2004 | Slavin |
| 6,819,334 | B1 | | 11/2004 | Owada et al. |
| 6,850,211 | B2 | | 2/2005 | Deppe |
| 6,901,429 | B2 | | 5/2005 | Dowling |
| 2001/0024326 | A1 | | 9/2001 | Nakamura et al. |
| 2001/0034077 | A1 | | 10/2001 | Wine et al. |
| 2002/0163701 | A1 | | 11/2002 | Plesko |
| 2002/0163702 | A1 | | 11/2002 | Hori et al. |

FOREIGN PATENT DOCUMENTS

KR 1020000073553 12/2000

* cited by examiner

*Primary Examiner* — Lun-Yi Lao
*Assistant Examiner* — Shaheda Abdin
(74) *Attorney, Agent, or Firm* — Kevin D. Wills

(57) ABSTRACT

A scanned beam display device scans a beam to paint an image. The beam is scanned in two dimensions and includes at least one sinusoidal component. Phase offsets are introduced to provide different scan trajectories for successive traversals of the image field of view.

14 Claims, 10 Drawing Sheets

PROJECTION SYSTEM WITH MULTI-PHASED SCANNING TRAJECTORY

FIELD

The present invention relates generally to display devices, and more specifically to scanned beam display devices.

BACKGROUND

In a typical scanned display system, a point of illumination is scanned in two dimensions to form a rasterized image. Typically, one scan axis (fast-scan axis) is scanned at an integer multiple of the other axis (slow-scan axis). Both axes are typically scanned with a unidirectional ramp or sawtooth function having an active video portion in which the point of illumination constructs the image and a "flyback" time during which illumination is disabled (i.e. blanked). The resulting fast-scan lines are all parallel to each other and this ensures a very uniform spatial resolution.

Some systems contain inertia that limits the frequency of the scan function in the fast-scan axis. Use of a sinusoidal scan function rather than a ramp allows the scan frequency to be increased. In this case, the image can be scanned bidirectionally (e.g., both left-to-right and right-to-left). Use of the sinusoidal scan function eliminates the need to "flyback" in the fast-scan axis which reduces or eliminates the blanking time.

FIG. 1 shows a scan trajectory having a sinusoidal component on the fast-scan axis (horizontal axis) and a sawtooth component on the slow-scan axis (vertical axis). Scan trajectory 100 is shown superimposed upon a grid 102. Grid 102 represents rows and columns of pixels that make up a display image. The rows of pixels are aligned with the horizontal dashed lines, and columns of pixels are aligned with the vertical dashed lines. The image is made up of pixels that occur at the intersections of dashed lines. On scan trajectory 100, the beam sweeps back and forth left-to-right in a sinusoidal pattern, and sweeps vertically (top-to-bottom) in a sawtooth pattern with the display blanked during flyback (bottom-to-top).

As shown in FIG. 1, the vertical sweep rate is typically set such that the number of horizontal sweeps equals the number of rows in the grid, and the vertical scan position at any time is approximated as a corresponding row. For example, as shown in FIG. 1, each horizontal sweep 110 from left-to-right corresponds to one row 112 and the following sweep from right-to-left 120 may correspond to the next row 122. In the displayed image, however, the horizontal fast-scan lines are not parallel to each other resulting in a non-uniform spatial resolution and the resulting image quality is degraded—especially at the extremes of the fast-scan axis. This image artifact is referred to as "raster pinch". Raster pinch is shown in FIG. 1 where pixels 134 and 138 are more closely spaced ("pinched") than pixels 138 and 144. Raster pinch is also shown where pixels 144 and 148 are pinched.

FIG. 2 shows prior art beam deflection waveforms that result in the scan trajectory of FIG. 1. Vertical deflection waveform 210 is a sawtooth waveform, and horizontal deflection waveform 260 is a sinusoidal waveform. Horizontal deflection waveform is a sinusoid having period $T_H$. Vertical deflection waveform 210 is a sawtooth waveform having period $T_V$ which is an integer multiple of $T_H$. The sawtooth vertical deflection waveform 210 includes a rising portion corresponding to the sweep of trajectory 100 from top-to-bottom, and also includes a falling portion corresponding to the flyback from bottom-to-top. After the flyback, the vertical sweep traverses substantially the same path on each trajectory.

Blanking waveform 280 is also shown in FIG. 2. The scanned beam is blanked (no pixels are displayed) during flyback, and is not blanked during the vertical sweep. For clarity, the flyback of the scanned beam is not shown in FIG. 1.

DESCRIPTION OF EMBODIMENTS

Figure 1:
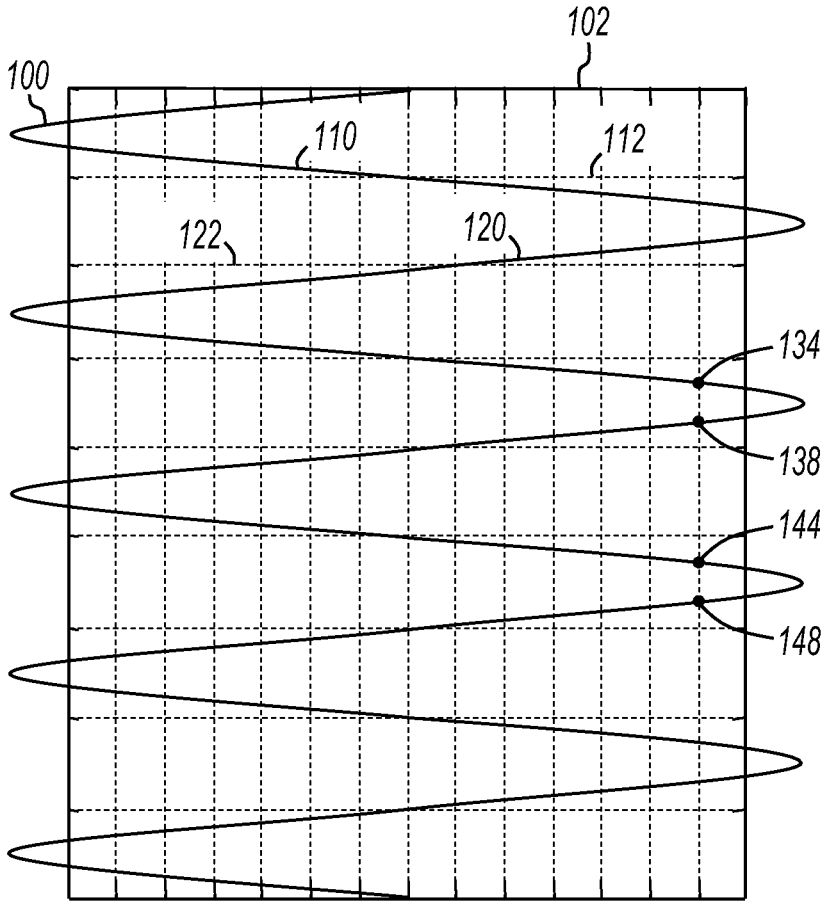
FIG. 1 PRIOR ART
FIG. 1 shows a prior art scan trajectory having a sinusoidal horizontal component and a linear vertical component.
Figure 2:
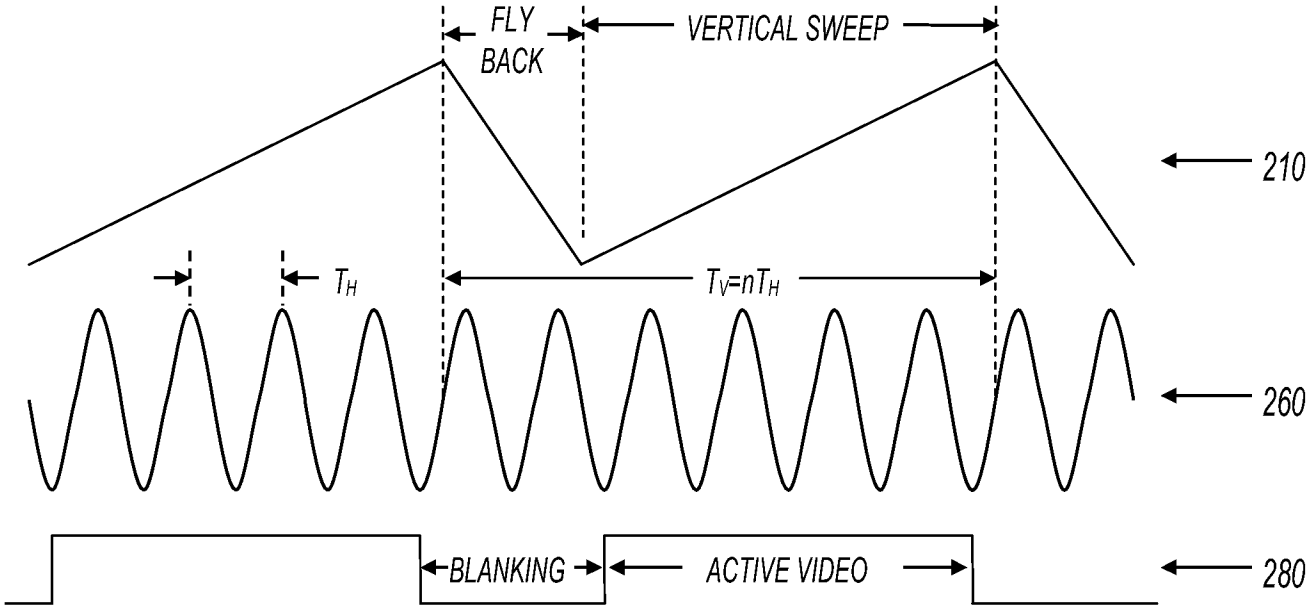
FIG. 2 PRIOR ART
FIG. 2 shows prior art vertical and horizontal deflection waveforms that result in the scan trajectory of FIG. 1.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

Figure 3:
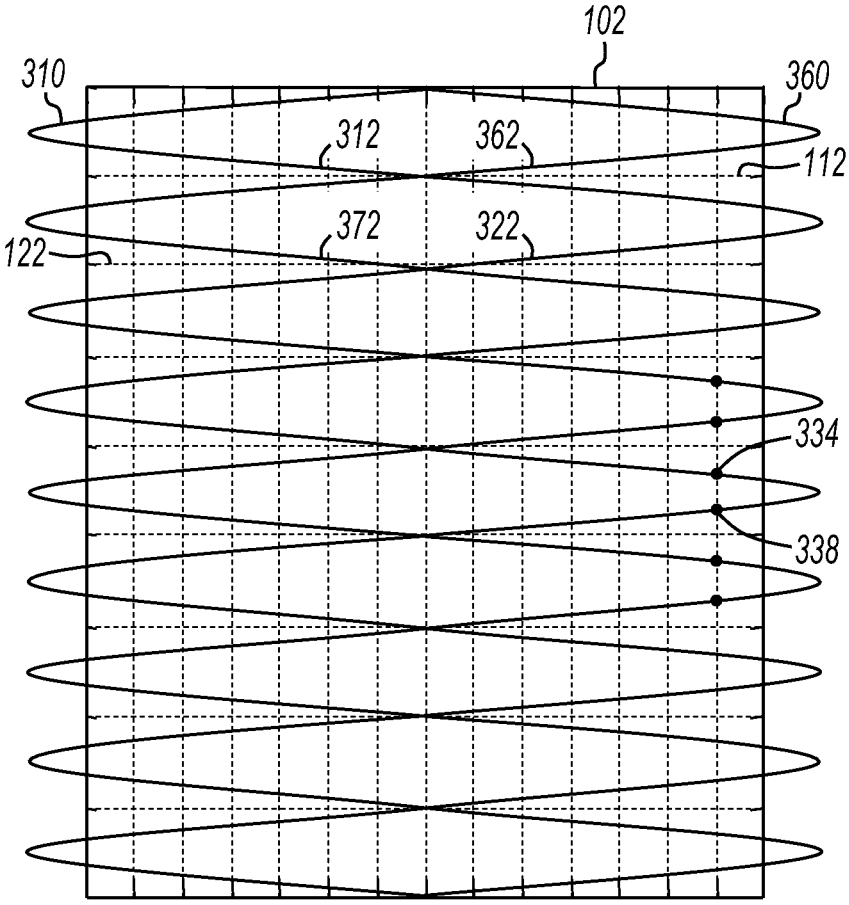
FIG. 3 shows a multi-phased scan trajectory traversing an image field of view.

FIG. 3 shows a multi-phased scan trajectory traversing an image field of view. The scan trajectory of FIG. 3 is shown superimposed on grid 102 (described above with reference to FIG. 1). The area within grid 102 represents an image field of view, and the intersections of dashed lines represent pixel locations within the image. The horizontal deflection is sinusoidal, and the vertical deflection is linear. As shown in FIG. 3, the scanned beam traverses the image field of view at least twice before repeating, where successive traversals have a phase offset. For example, the beam traverses the image field of view at 310 and then again at 360 with a phase offset of 180 degrees before repeating. The term "trajectory" is used herein to describe any portion of the entire scanning pattern that traverses the image field of view. For example, trajectory 310 traverses the field of view, as does trajectory 360. Trajectory 360 and trajectory 310 are referred to as being successive.

FIG. 3 shows two trajectories having a phase offset of 180 degrees. Any number of trajectories may exist where each successive trajectory has a phase offset relative to the previous trajectory. For example, in some embodiments, three trajectories with phase offsets of 120 degrees are used. Also for example, in some embodiments, four trajectories with phase offsets of 90 degrees are used.

Multi-phased scanning trajectories in accordance with various embodiments of the present invention may be produced in many ways. For example, in some embodiments, trajectory 310 is scanned from top-to-bottom, then the beam flies back to the top, and then trajectory 360 is scanned from top-to-bottom. In other embodiments, trajectory 310 is scanned from top-to-bottom, and then trajectory 360 is scanned from bottom-to-top. Deflection waveforms for various embodiments are described below with reference to later figures.

By including multiple trajectories with phase offsets, the visual effects of raster pinch can be mitigated because blank areas within the image field of view existing in the prior art (FIG. 1) can be "filled in". For example, trajectory 360 paints pixels 334 and 338 in an area that is blank in FIG. 1.

In some embodiments, each horizontal sweep corresponds to a row of pixels. For example, each horizontal sweep 312 of trajectory 310 from left-to-right corresponds to one row 112 and the following sweep from right-to-left 322 may correspond to the next row 122. Also for example, each horizontal sweep 362 of trajectory 360 from right-to-left corresponds to one row 112 and the following sweep from left-to-right 372 may correspond to the next row 122. In these embodiments, each trajectory paints all of the pixels. For example, trajectory 310 paints pixels in rows 112 and 122 during sweeps 312 and 322, and trajectory 360 also paints pixels in rows 112 and 122 during sweeps 362 and 372.

In some embodiments, displayed pixel data is interpolated. For example, pixel 334 may display data interpolated from actual pixel data in the rows above and below. Interpolation may be performed vertically, horizontally, or both.

As shown in FIG. 3, in some embodiments, each trajectory paints all pixels in the image as it traverses the image field of view. For example, both trajectories 310 and 360 paint pixels in row 112. The two trajectories repeatedly intersect as they paint pixels in the image field of view.

Figure 4:
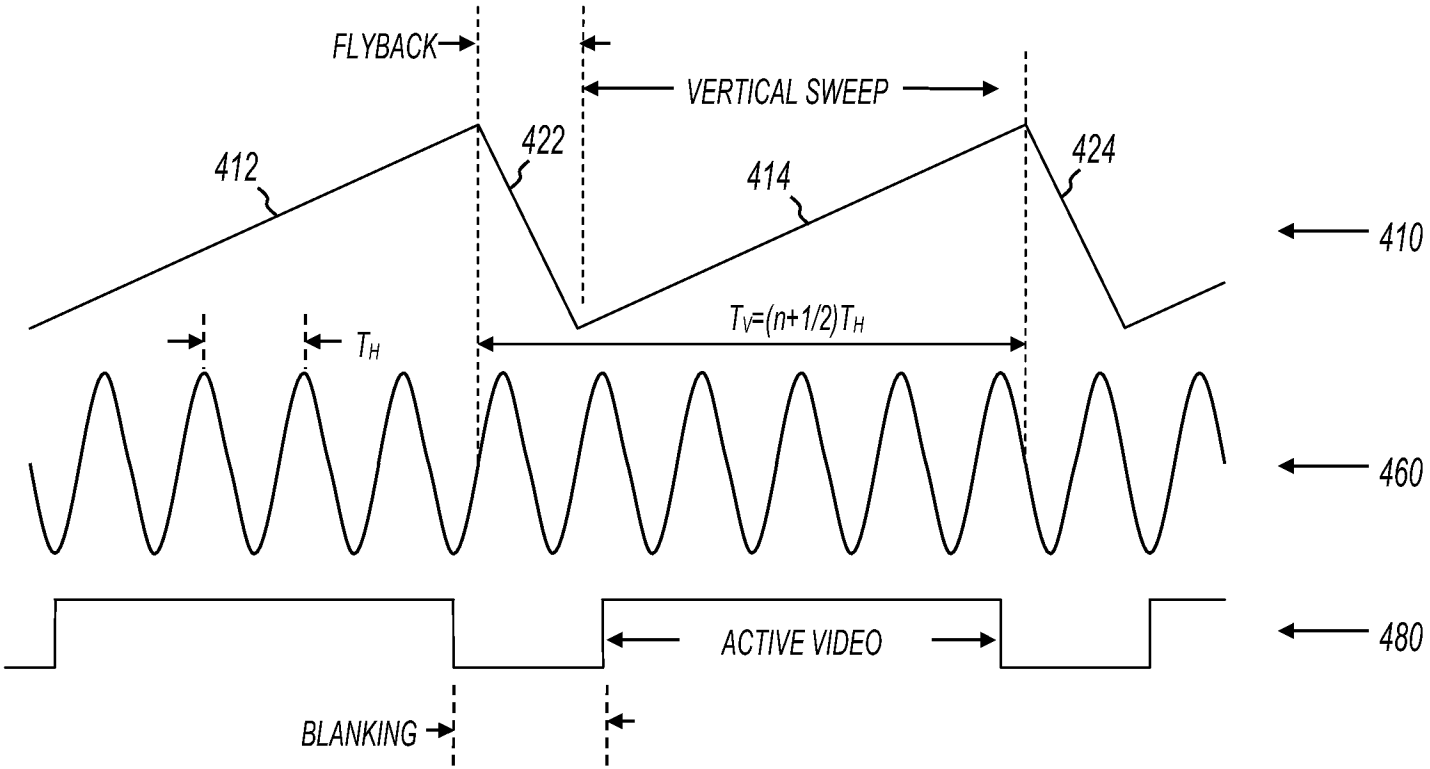
FIGS. 4 and 5 show deflection waveforms that result in the scan trajectory of FIG. 3.

FIG. 4 shows deflection waveforms that result in the scan trajectory of FIG. 3. Vertical deflection waveform 410 is a sawtooth waveform, and horizontal deflection waveform 460 is a sinusoidal waveform. Horizontal deflection waveform 460 is a sinusoid having period $T_H$. Vertical deflection waveform 410 is a sawtooth waveform having period $T_V$ which is a non-integer multiple of $T_H$. Stated differently, the fundamental frequency of the horizontal deflection waveform is a non-integer multiple of the fundamental frequency of the vertical deflection waveform. In the example of FIG. 4, $T_V$ and $T_H$ are related by $$T_V=(n+1/2)T_H \tag{1}$$

where n is an integer. The offset value of ½ results in a phase offset of 180 degrees between successive vertical trajectories as shown in FIG. 3. In some embodiments, the offset value is other than ½. In general, $T_V$ and $T_H$ may be related by $$T_V=(n+1/x)T_H \tag{2}$$

where both n and x are integers. For example, in some embodiments, x=3, phase offsets between successive vertical trajectories are 120 degrees, and there are three vertical trajectories before they repeat.

Sawtooth vertical deflection waveform 410 includes vertical sweep portions 412 and 414 corresponding to trajectories 310 and 360 (FIG. 3), respectively. Sawtooth vertical deflection waveform 410 also includes flyback portions 422 and 424 corresponding to the beam "flying back" to the top of the image field of view. In the example of FIG. 4, successive vertical trajectories are offset by 180 degrees. After two vertical trajectories, the scan trajectory repeats.

Blanking waveform 480 is also shown in FIG. 4. The scanned beam is blanked (no pixels are displayed) during flyback, and is not blanked during the vertical sweep. For clarity, the flyback of the scanned beam is not shown in FIG. 3.

Figure 5:
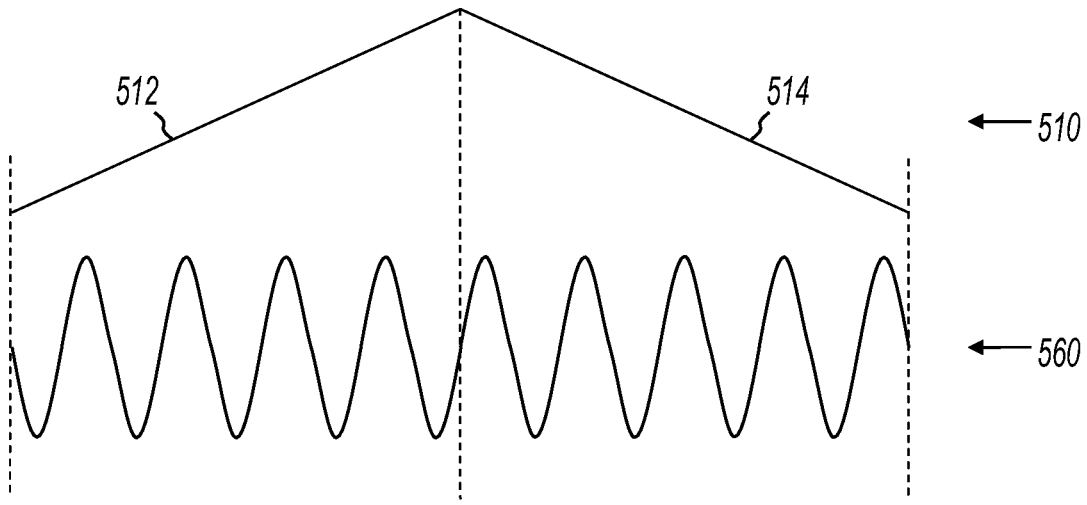

FIG. 5 shows deflection waveforms that result in the scan trajectory of FIG. 3. Vertical deflection waveform 510 is a triangular waveform, and horizontal deflection waveform 560 is a sinusoidal waveform. In some embodiments, pixels are painted as the beam sweeps from top-to-bottom as well as from bottom-to-top. For example, during the rising portion 512 of the vertical triangular waveform, the beam sweeps trajectory 310 (FIG. 3) from top-to-bottom, and during falling portion 514, the beam sweeps trajectory 360 (FIG. 3) from bottom-to-top. Successive vertical traversals in opposite directions result in a phase offset of 180 degrees as shown in FIG. 3.

Figure 6:
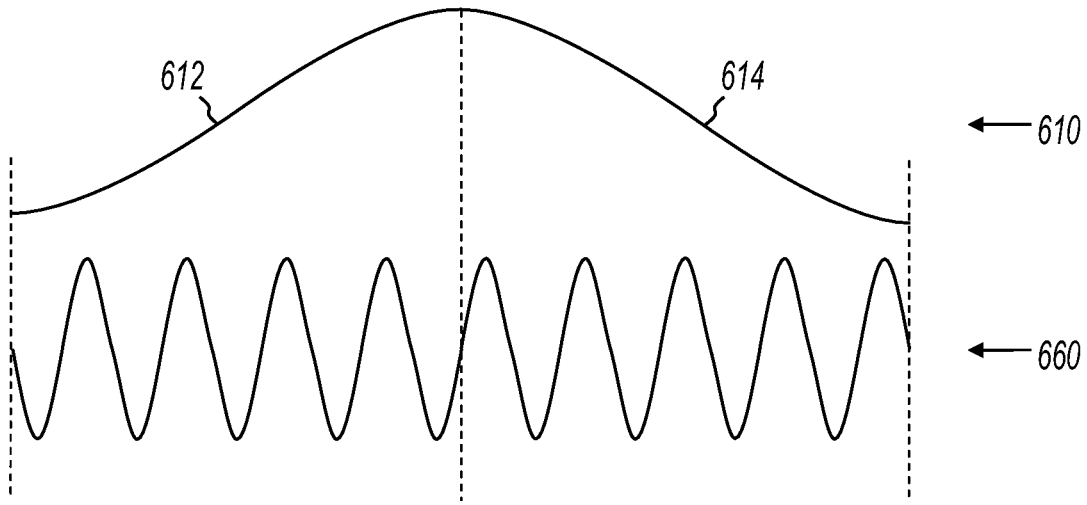
FIG. 6 shows deflection waveforms that result in a multi-phased scan trajectory.

FIG. 6 shows deflection waveforms that result in a multi-phased scan trajectory. Both vertical deflection waveform 610 and horizontal deflection waveform 660 are sinusoidal waveforms. In some embodiments, pixels are painted as the beam sweeps from top-to-bottom as well as from bottom-to-top. The scan trajectory that results from the deflection waveforms shown in FIG. 6 has a 180 degree offset similar to that shown in FIG. 3. The resulting scan trajectory differs from that shown in FIG. 3, however, because the vertical deflection waveform is sinusoidal resulting in a varying vertical sweep rate. In some embodiments, such as those represented by FIG. 6, displayed pixel data may be interpolated from pixel data corresponding to the underlying image.

Figure 7:
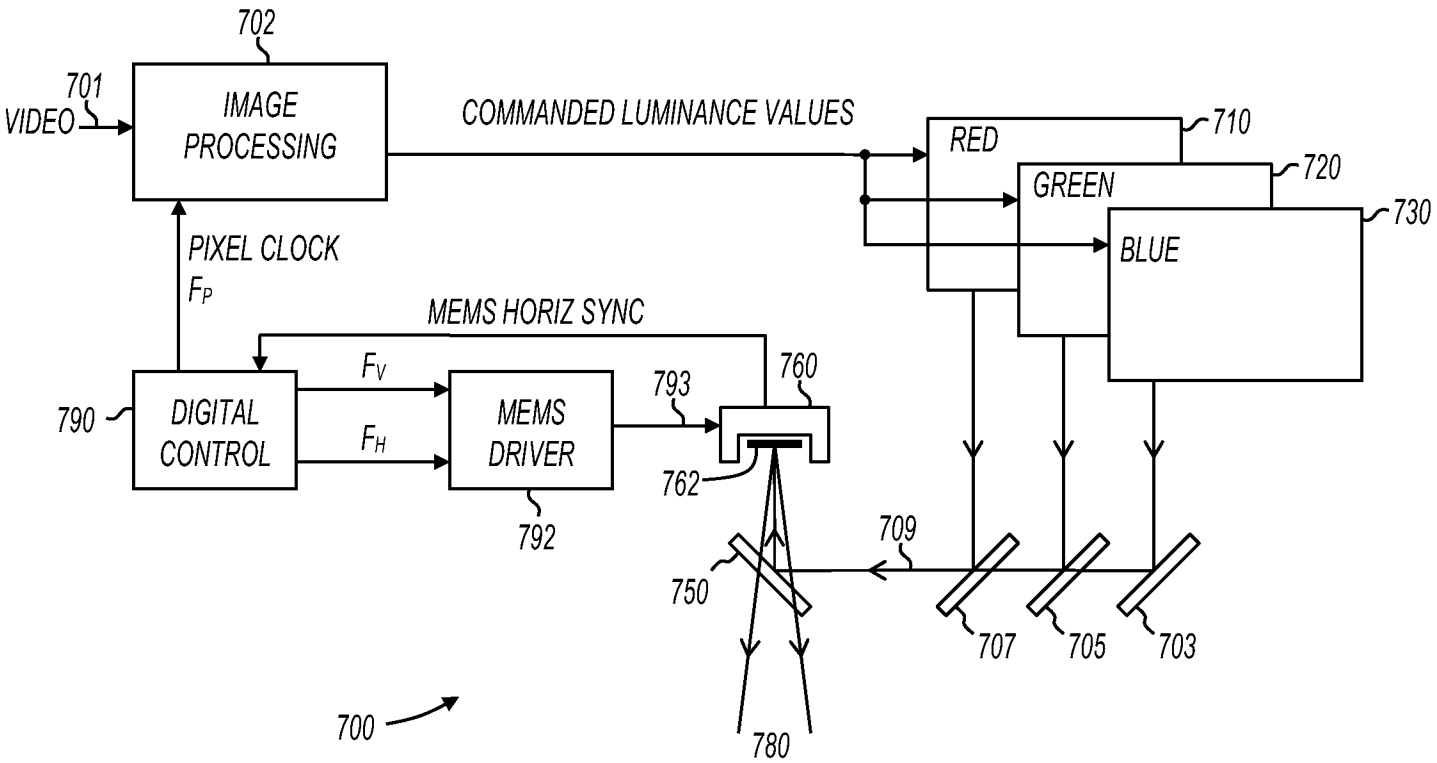
FIG. 7 shows a scanned beam display system with a multi-phased scan trajectory.

FIG. 7 shows a projection system with a multi-phased scan trajectory. System 700 includes image processing component 702, laser light sources 710, 720, and 730. Projection system 700 also includes mirrors 703, 705, and 707, filter/polarizer 750, micro-electronic machine (MEMS) device 760 having mirror 762, MEMS driver 792, and digital control component 790.

In operation, image processing component 702 receives video data on node 701, receives a pixel clock at frequency $F_P$ from digital control component 790, and produces commanded luminance values to drive the laser light sources when pixels are to be displayed. Red, green, and blue light is provided by the laser light sources, although other light sources, such as color filters or light emitting diodes (LEDs) or edge-emitting LEDs, could easily be substituted. One advantage of lasers is that their light is collimated, and emerges as a narrow beam. When each beam is directed at the MEMS mirror (either directly or through guiding optics) the colors of light can be mixed on the surface of the mirror, pixel by pixel.

The MEMS mirror rotates on two axes in response to electrical stimuli received on node 793 from MEMS driver 792. The two axes are referred to as the fast-scan axis and the slow-scan axis. In the example embodiments described herein, the fast-scan axis is the horizontal axis, but this is not a limitation of the present invention. The fast-scan axis can be the vertical axis without departing from the scope of the present invention.

In some embodiments, the mirror sweeps back and forth on the fast-scan axis at a resonant frequency. In these embodiments, the pixel clock and the slow scan-axis frequency are derived from the resonant frequency of the MEMS device. Digital control component 790 receives a MEMS horizontal sync signal from MEMS device 760 and derives the horizontal frequency $F_H$, the vertical frequency $F_V$, and the pixel clock frequency $F_P$. Various embodiments of digital control block 790 are described below with reference to FIG. 8.

As described with reference to previous figures, the relationship(s) between the horizontal and vertical deflection signals provide phase offsets between successive traversals through the image field of view. For example, in some embodiments, the beam may sweep back and forth horizontally in a sinusoidal pattern while the beam sweeps vertically in a sawtooth pattern. Also for example, in some embodiments, the beam may sweep back and forth horizontally in a sinusoidal pattern while the beam sweeps vertically in a triangular or sinusoidal pattern. Pixels may be displayed when the beam is sweeping in one direction or in both directions. For example, in some embodiments, pixels may be displayed as the beam sweeps down in the vertical direction, but not when the beam sweeps back up. Also for example, in some embodiments, pixels may be displayed as the beam sweeps down as well as when the beam sweeps up in the vertical direction.

The MEMS based projector is described as an example, and the various embodiments of the invention are not so limited. For example, other projector types may be included in scanned beam display systems with multi-phased trajectories without departing from the scope of the present invention.

Figure 8:
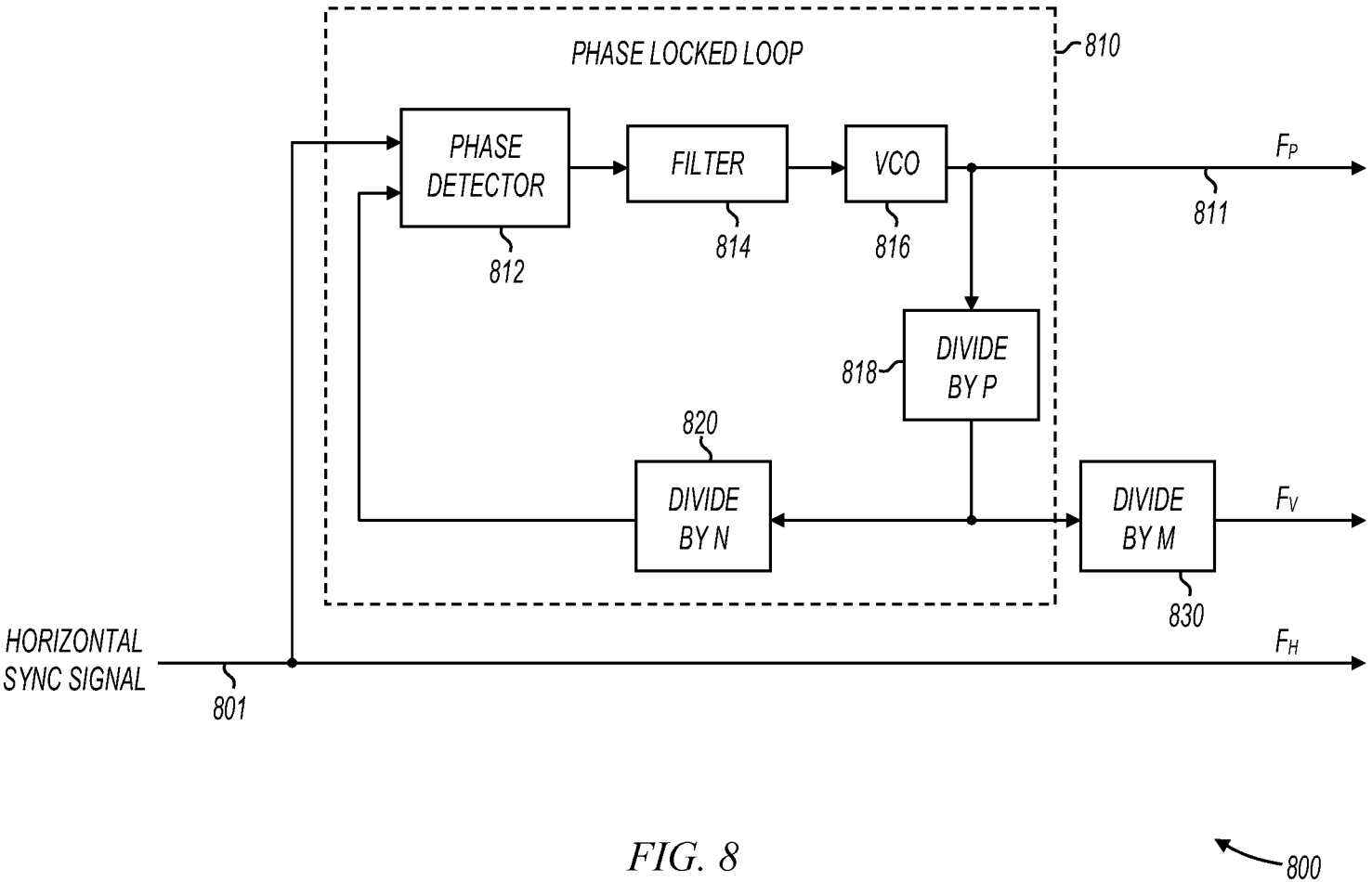
FIG. 8 shows a digital control component to produce control signals from a MEMS sync signal.

FIG. 8 shows a digital control component to produce control signals from a MEMS sync signal. Component 800 may be used as digital control component 790 (FIG. 7). Component 800 receives the horizontal sync signal on node 801 and passes it through as the horizontal frequency $F_H$. In some embodiments, the signal is conditioned prior to passing through. For example, the horizontal sync signal may be amplified, level shifted, frequency multiplied, duty cycle modified, or the like.

The horizontal sync signal is also provided to phase locked loop (PLL) 810. PLL 810 includes phase detector 812, filter 814, voltage controlled oscillator 816, and frequency dividers 818 and 820. PLL 810 operates to multiply the horizontal sync signal up to the pixel frequency $F_P$. The pixel frequency is related to the horizontal frequency as:

$$F_P=F_H\times P\times N \tag{3}$$

where P×N is the number of pixels in one horizontal deflection period, and N is the number of non-overlapping trajectories before the scan trajectory repeats.

Component 800 also includes frequency divider 830. Frequency divider 830 divides the input signal by M where M is the number of horizontal deflection signal periods in all non-overlapping trajectories. The combination of PLL 810 and divider 830 operate to divide the horizontal sync signal down to the frequency of the vertical deflection signal. The vertical frequency is related to the horizontal frequency as:

$$F_V=F_H\times N/M. \tag{4}$$

The following values for the various parameters in FIG. 8 are provided as examples. Many other combinations of parameter values may be used without departing from the scope of the present invention. In one embodiment, $F_H$=21.5 KHz, P=2250, N=2, and M=725, yielding $F_P$=96.75 MHz and $F_V$=59.3 Hz.

With N=2 and M=725, the ratio of the vertical deflection signal period to the horizontal deflection signal period is equal to 725/2, or 362.5. This fits with equation 1, above, with n=362.

In another embodiment, $F_H$=21.5 KHz, P=1500, N=3, and M=1087, yielding $F_P$=96.75 MHz and $F_V$=59.3 Hz.

With N=3 and M=1087, the ratio of the vertical deflection signal period to the horizontal deflection signal period is equal to 1087/3, or 362+⅓. This fits with equation 2, above, with n=362 and x=3.

Figure 9:
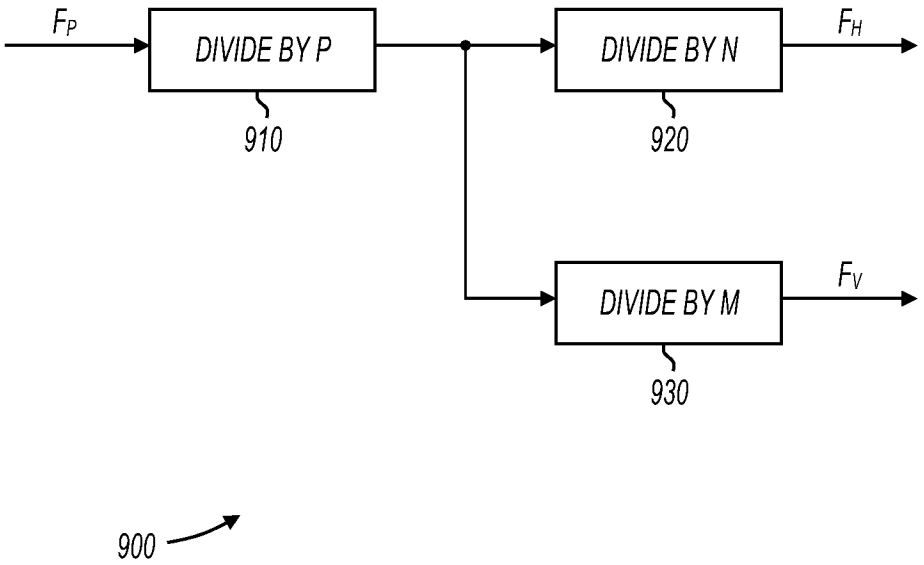
FIG. 9 shows a digital control component to produce control signals from a pixel clock signal.

FIG. 9 shows a digital control component to produce control signals from a pixel clock signal. Component 900 may be used in any scanning display system to produce multiple successive vertical trajectories with phase offsets to mitigate raster pinch. Because component 900 divides the pixel clock to arrive at the vertical and horizontal frequencies, a PLL is not needed.

Component 900 includes frequency dividers 910, 920, and 930. Frequency dividers 910 and 920 operate to produce the horizontal frequency by dividing the pixel clock by P and N, where P×N is the number of pixels in one horizontal deflection period, and N is the number of non-overlapping vertical trajectories before the scan trajectory repeats. Accordingly:

$$F_V=F_P/(P\times N). \tag{5}$$

Frequency dividers 910 and 930 operate to produce the vertical frequency by dividing the pixel clock by P and M, where P is the number of pixels in a scan line, and M is the number of horizontal deflection signal periods in all non-overlapping trajectories. Accordingly:

$$F_H=F_P/(P\times M) \tag{6}$$

Figure 10:
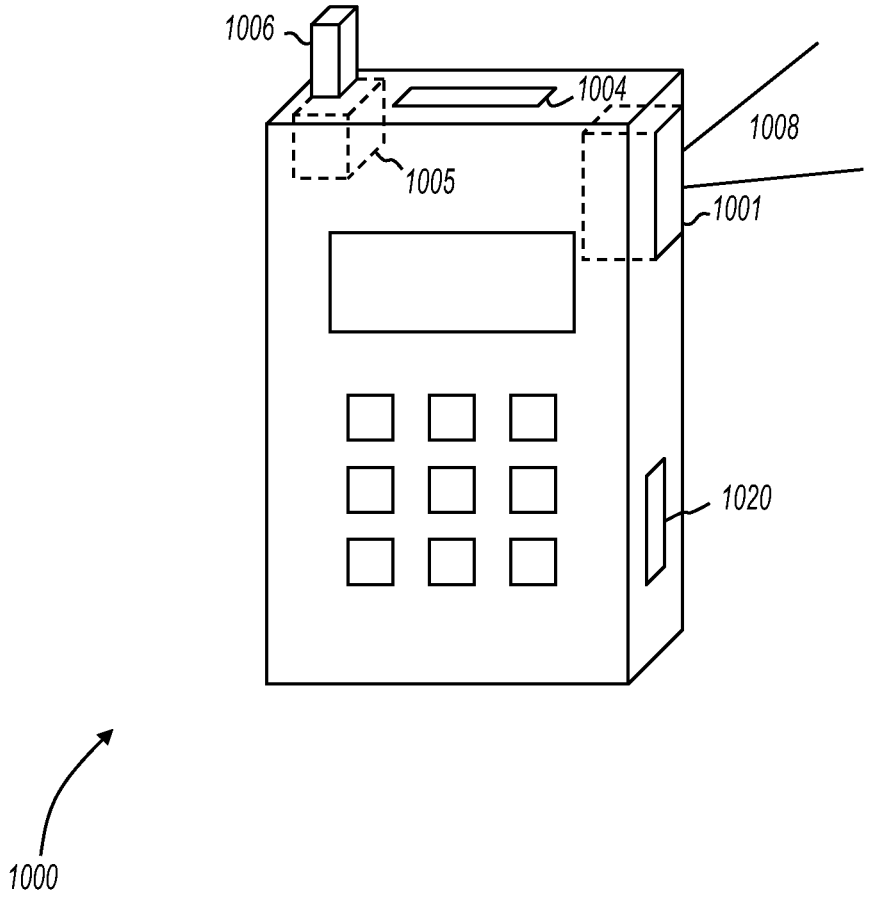
FIG. 10 shows a mobile device in accordance with various embodiments of the present invention.

FIG. 10 shows a mobile device in accordance with various embodiments of the present invention. Mobile device 1000 may be a hand held projection device with or without communications ability. For example, in some embodiments, mobile device 1000 may be a handheld projector with little or no other capabilities. Also for example, in some embodiments, mobile device 1000 may be a device usable for communications, including for example, a cellular phone, a smart phone, a personal digital assistant (PDA), a global positioning system (GPS) receiver, or the like. Further, mobile device 1000 may be connected to a larger network via a wireless (e.g., WiMax) or cellular connection, or this device can accept data messages or video content via an unregulated spectrum (e.g., WiFi) connection.

Mobile device 1000 includes scanning projection device 1001 to create an image with light 1008. Similar to other embodiments of projection systems described above, mobile device 1000 may include a projector with multi-phased scan trajectories.

In some embodiments, mobile device 1000 includes antenna 1006 and electronic component 1005. In some embodiments, electronic component 1005 includes a receiver, and in other embodiments, electronic component 1005 includes a transceiver. For example, in GPS embodiments, electronic component 1005 may be a GPS receiver. In these embodiments, the image displayed by scanning projection device 1001 may be related to the position of the mobile device. Also for example, electronic component 1005 may be a transceiver suitable for two-way communications. In these embodiments, mobile device 1000 may be a cellular telephone, a two-way radio, a network interface card (NIC), or the like.

Mobile device 1000 also includes memory card slot 1004. In some embodiments, a memory card inserted in memory card slot 1004 may provide a source for video data to be displayed by scanning projection device 1001. Memory card slot 1004 may receive any type of solid state memory device, including for example, Multimedia Memory Cards (MMCs), Memory Stick DUOs, secure digital (SD) memory cards, and Smart Media cards. The foregoing list is meant to be exemplary, and not exhaustive.

Mobile device 1000 also includes data connector 1020. In some embodiments, data connector 1020 can be connected to one or more cables to receive analog or digital video data for projection by scanning projection device 1001. In other embodiments, data connector 1020 may mate directly with a connector on a device that sources video data.

Figure 11:
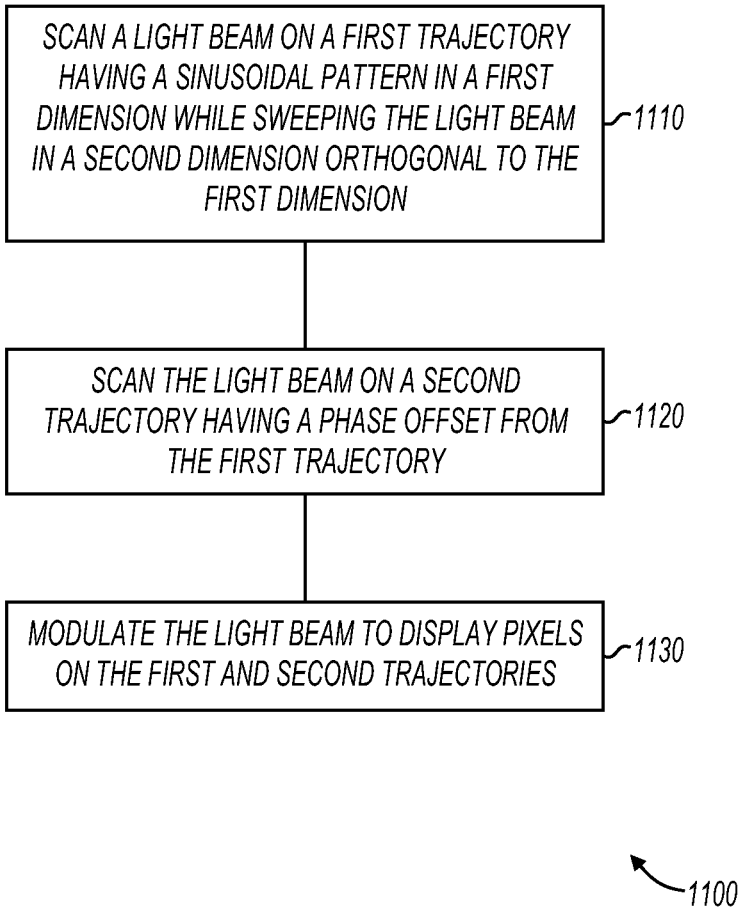
FIG. 11 shows a flowchart in accordance with various embodiments of the present invention.

FIG. 11 shows a flowchart in accordance with various embodiments of the present invention. In some embodiments, method 1100, or portions thereof, is performed by a scanning display system, a mobile projector, or the like, embodiments of which are shown in previous figures. In other embodiments, method 1100 is performed by an integrated circuit or an electronic system. Method 1100 is not limited by the particular type of apparatus performing the method. The various actions in method 1100 may be performed in the order presented, or may be performed in a different order. Further, in some embodiments, some actions listed in FIG. 11 are omitted from method 1100.

Method 1100 is shown beginning with block 1110 in which a light beam is scanned on a first trajectory having a sinusoidal pattern in a first dimension while sweeping the light beam in a second dimension orthogonal to the first dimension. In some embodiments, the first dimension is a horizontal fast-scan dimension, and the second dimension is a vertical slow-scan dimension. The sinusoidal pattern may be as shown in FIG. 3. The sweeping of the light beam in the second dimension may be linear or nonlinear. For example, the beam may be swept vertically in a linear fashion using a ramp that is part of a sawtooth waveform or a triangular waveform as shown in FIGS. 4 and 5. Also for example, the beam may be swept vertically in a non-linear fashion using a sinusoid as shown in FIG. 6.

At 1120, the light beam is scanned on a second trajectory having a phase offset from the first trajectory. In some embodiments, this includes a flyback and a subsequent trajectory in the same direction (e.g., top-to-bottom) as the first trajectory. In other embodiments, this includes a trajectory in the opposite direction. For example, the first trajectory may be from top-to-bottom, and the second trajectory may be from bottom-to-top. Pixels may be painted in both trajectories: top-to-bottom, bottom-to-top, left-to-right, and right-to-left.

Phase offsets may have any value, and any number of non-overlapping trajectories may be included. For example, a phase offset of 180 degrees may be used with two trajectories over an image field of view before the scan trajectory repeats. Also for example, a phase offset of 120 degrees may be used with three trajectories over the image field of view before the scan trajectory repeats.

At 1130, the light beam is modulated to display pixels on the first and second trajectories. In some embodiments, the light beam includes multiple colors, and each color is modulated separately. In other embodiments, the light beam is monochromatic, an only one color is modulated. By including multiple trajectories having phase offsets, the effects of raster pinch may be mitigated.

Although the present invention has been described in conjunction with certain embodiments, it is to be understood that modifications and variations may be resorted to without departing from the spirit and scope of the invention as those skilled in the art readily understand. Such modifications and variations are considered to be within the scope of the invention and the appended claims.

What is claimed is:

1. A scanned beam projection system comprising:

at least one laser light source to produce a visible beam;

a micro-electronic machine (MEMS) mirror to deflect the visible beam in a plurality of scan trajectories, wherein each of the plurality of scan trajectories includes one vertical sweep and a plurality of horizontal sweeps, the plurality of horizontal sweeps being sinusoidal; and driver circuitry to provide at least one drive signal to the MEMS mirror to provide a phase offset for successive vertical sweeps, to cause the visible beam to traverse at least two different scan trajectories of the plurality of scan trajectories before repeating.

2. The scanned beam projection system of claim 1 wherein the vertical sweep is linear.

3. The scanned beam projection system of claim 1 wherein the vertical sweep is sinusoidal.

4. The scanned beam projection system of claim 1 wherein the phase offset is substantially 180 degrees.

5. The scanned beam projection system of claim 1 further comprising image processing circuitry to drive the at least one laser light source to cause pixels to be displayed along the scan trajectory.

6. The scanned beam projection system of claim 5 wherein the image processing circuit is operable to cause pixels to be displayed during horizontal sweeps from left-to-right and right-to-left.

7. The scanned beam projection system of claim 5 wherein the image processing circuit is operable to cause pixels to be displayed during vertical sweeps from top-to-bottom and bottom-to-top.

8. A mobile device comprising:

a communications transceiver; and a projection apparatus that includes a micro-electronic machine (MEMS) mirror to deflect a laser light beam in two dimensions to repeatedly traverse an image field of view and paint pixels, wherein each traversal follows one of a plurality of scan trajectories that each include one sweep in a first of the two dimensions and multiple sweeps in a second of the two dimension, and wherein a phase offset is introduced on each traversal to cause different scan trajectories of the plurality of scan trajectories on successive before repeating traversals.

9. The mobile device of claim 8 wherein the phase offset is substantially 180 degrees.

10. A method comprising:

scanning a light beam on a first trajectory of a plurality of trajectories, each of the plurality of trajectories having a sinusoidal pattern in a first dimension while sweeping the light beam in a second dimension orthogonal to the first dimension, wherein each of the plurality of trajectories includes multiple sweeps in the first dimension and one sweep in the second dimension;

introducing a phase offset in the first dimension; and scanning the light beam on a second trajectory offset from the first trajectory in the first dimension to cause the light beam to traverse at least two different trajectories of the plurality of trajectories before repeating.

11. The method of claim 10 further comprising modulating the light beam to display pixels on the first and second trajectories.

12. The method of claim 10 wherein scanning the light beam on the first trajectory and the second trajectory comprises driving a micro-electronic machine (MEMS) device with a sinusoidal horizontal deflection signal having a first period, and a vertical deflection signal having a second period that is a non-integer multiple of the first period.

13. A projector comprising:

a scanning mirror that sweeps a scanned beam on a plurality of trajectories across a field of view linearly in a vertical dimension and sinusoidally in a horizontal dimension, wherein each trajectory includes one sweep in the vertical dimension and multiple sweeps in the horizontal dimension; and a scanning mirror driver to cause the scanning mirror to incur phase offsets in the horizontal dimension for successive vertical sweeps such that the scanned beam traverses the field of view on at least two different trajectories of the plurality of trajectories before repeating.

14. The projector of claim 13 wherein the scanning mirror driver causes a 180 degree phase offset such that the scanned beam traverses the field of view twice before repeating.

* * * * *